US008056574B2

(12) United States Patent
Erickson et al.

(10) Patent No.: US 8,056,574 B2
(45) Date of Patent: Nov. 15, 2011

(54) ADJUSTABLE VALVE ASSEMBLY

(75) Inventors: Perry Dennis Erickson, Sheboygan, WI (US); Steven Thomas Radder, Kiel, WI (US)

(73) Assignee: Kohler Co., Kohler, WI (US)

( * ) Notice: Subject to any disclaimer, the term of this patent is extended or adjusted under 35 U.S.C. 154(b) by 324 days.

(21) Appl. No.: 12/353,105

(22) Filed: Jan. 13, 2009

(65) Prior Publication Data

US 2010/0176328 A1 Jul. 15, 2010

(51) Int. Cl.
*F16K 27/00* (2006.01)

(52) U.S. Cl. ..... 137/15.18; 137/360; 137/454.5; 137/315.41

(58) Field of Classification Search ..... 137/360, 137/454.5, 801, 359, 15.18, 315.41
See application file for complete search history.

(56) References Cited

U.S. PATENT DOCUMENTS

| | | | | |
|---|---|---|---|---|
| 1,665,436 | A * | 4/1928 | Bloch | 137/360 |
| 3,067,436 | A | 12/1962 | Freibott | |
| 3,331,386 | A | 7/1967 | Politz | |
| 3,376,888 | A | 4/1968 | Anthony | |
| 3,796,228 | A * | 3/1974 | Bedo et al. | 137/536 |
| 4,463,460 | A | 8/1984 | Arnold et al. | |
| 4,662,389 | A | 5/1987 | Igbal | |
| 4,738,277 | A * | 4/1988 | Thomas | 137/454.5 |
| 4,852,192 | A | 8/1989 | Viegener | |
| 4,880,209 | A * | 11/1989 | Bernat | 137/454.5 |
| 4,896,381 | A | 1/1990 | Hutto | |
| 5,031,877 | A * | 7/1991 | Mercer | 137/360 |
| 6,345,643 | B1 | 2/2002 | Ko | |
| 6,421,849 | B1 | 7/2002 | Gray | |
| 6,666,227 | B2 | 12/2003 | Erickson | |
| 6,668,393 | B1 | 12/2003 | Mascari et al. | |
| 6,899,117 | B2 | 5/2005 | Marks | |
| 6,905,298 | B1 * | 6/2005 | Haring | 411/432 |
| 7,523,783 | B2 * | 4/2009 | Victor | 166/68 |

FOREIGN PATENT DOCUMENTS

CH 000296918-0006 4/2005

OTHER PUBLICATIONS 6 pages of a PCT report dated Apr. 22, 2010 in a corresponding application PCT/US2010/020715.

* cited by examiner

*Primary Examiner* — Kevin Lee
(74) *Attorney, Agent, or Firm* — Foley & Lardner LLP

(57) ABSTRACT

A valve assembly is disclosed for mounting through a wall having a first face and a second face defining a thickness there between. The valve assembly includes a valve body housing having an axially-extending inner bore. A valve body is telescopically received in the inner bore of the valve body housing, such that the valve body is axially movable with respect to the valve body housing. A valve is nested in a recess of the valve body. A locking element selectively engages the valve body housing and the valve body to lock a position of the valve body relative to the valve body housing.

15 Claims, 7 Drawing Sheets

ADJUSTABLE VALVE ASSEMBLY

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

This invention relates to plumbing valves, and in particular, to adjustable mounting systems for use therewith.

Many valve assemblies are installed through a wall or surface. For example, valve assemblies may be installed in walls for faucets, showers, and the like. To hide the mounting hardware, these valve assemblies are typically anchored against the back side of the wall frame and project forward. Once the valve assembly is fixed in place, the wall covering is attached. Of course, the wall covering will have the necessary cutouts for the valve assembly to extend through. In some cases, a handle and/or an escutcheon may be separately attached to the valve assembly on the front side of the wall.

However, the thickness of the wall may vary depending on the construction materials selected. Thus, the installation often involves doing a first rough-in installation and any corrections for depth are made during the final installation.

To reduce the need for a separate rough-in installation, adjustable mounting systems have been developed. See e.g., U.S. Pat. Nos. 3,331,386; 4,662,389; and 6,666,227. Many adjustable mounting systems for valve assemblies exploit the fact that an escutcheon covers a portion of the neck of the valve. By altering the positioning of the escutcheon, minor over -or under-extension of the valve assembly from the mounting surface can be hidden. Adjustment of the escutcheon works well for many kinds of valves having handles that move about a fixed rotational axis.

Even in valves having a fixed rotational axis, the amount of escutcheon adjustment can be quite limited. The amount of escutcheon adjustment may be limited by the spacing between the handle and the valve body or the amount of threading along the shaft to which the escutcheon is connected. If the threading extended too far, it can diminish the appearance of the fixture.

Further, adjustment of escutcheon will not work with all types of valves and aesthetic designs. For example, certain types of mixing valves have pivot centers that must be a predetermined distance from the wall covering. Often the pivot center may have some spatial relationship with the escutcheon that makes adjustment of the escutcheon along a central axis unacceptable as a means for accommodating installation into walls of various thicknesses.

Hence, a need exists for an improved valve assembly that is easily installed in walls of different thicknesses. In particular, there is a need for a valve assembly that provides for the placement of valve components at a predetermined distance from the front side of the wall using a rear side mounting, regardless of wall thickness.

SUMMARY OF THE INVENTION

A valve assembly is disclosed for mounting through a wall having a first face and a second face defining a thickness there between. The valve assembly includes a valve body housing having an axially-extending inner bore. A valve body is telescopically received in the inner bore of the valve body housing, such that the valve body is axially movable with respect to the valve body housing. A valve is nested in a recess of the valve body. A locking element selectively engages the valve body housing and the valve body to lock a position of the valve body relative to the valve body housing.

In one form of the valve assembly, a radially outward facing surface of the valve body and a radially inward facing surface of the inner bore of the valve body housing each may have threads. Further, the locking element may be a threaded ring having radially outward facing threads that selectively engage the threads of the valve body housing and radially inward facing threads that selectively engage the threads of the valve body. The inner bore of the valve body housing may include a stop adjacent to the threads on the inner bore of the valve housing.

In another form of the valve assembly, the valve may be a joystick valve having a pivot center. When the valve body housing is mounted to the first side of the wall, the valve body may be adjustable such that a pivot center of the joystick valve received therein is a predetermined distance from the second side of the wall.

In yet another form of the valve assembly, the valve assembly may further include a mounting flange on the valve body housing.

In still yet another form of the valve assembly, the valve assembly may further include a pin having a channel running therethrough. The pin may be fixed relative to the valve body housing and slidably received in a bay formed in the valve body. The channel in the pin may place the valve in fluid communication with a port on the valve body housing that connects to a water inlet pathway formed in the valve body housing. The valve body may include at least one inlet channel formed therein to place the bay in fluid communication with the valve nested in the recess. The valve body may further include an outlet channel to place the valve in fluid communication with a water outlet pathway formed in the valve body housing. There may a first o-ring between the pin and the bay that forms a first slidable seal and a second o-ring between the valve body and the valve body housing that forms a second slideable seal.

Additionally, a multi-purpose tool for installation of the valve assembly is disclosed. The multi-purpose tool includes a tubular body axially extending from a first end to a second end. A mating edge on the first end has teeth for engagement with corresponding features on the locking element. The multi-purpose tool serves as a mud guard during an installation of a wall covering. The multi-purpose tool inserts between the valve body and the valve body housing to selectively engage the locking element.

In one form of the multi-purpose tool, the tubular body may have at least one radially-extending hole formed therein.

A method of installing a valve assembly into a wall is also disclosed. A valve body is telescopically moved into an axially-extending inner bore of a valve body housing. The valve body housing is mounted to a wall member on a first side of the wall. A wall covering is applied to the wall member to provide a second side of the wall. The valve body is moved within the valve body housing to position the valve body relative the second side of the wall. The valve body is then locked relative to the valve body housing using a locking element.

In one form of the method, a multi-purpose tool may be used as a mud guard during application of the wall covering. This protects the valve assembly. The multi-purpose tool may also be used to manipulate the locking element to lock the valve body to the valve body housing.

In another form of the method, a handle may be installed to the valve assembly on the second side of the wall.

In still yet another form of the method, the step of moving the valve body within the valve body housing to position the valve body relative to a second side of the wall includes positioning a pivot center of the valve relative to the second side of the wall.

Thus, a valve assembly is provided that is easily installed in walls of various thicknesses. As the valve assembly is adjusted in-wall during the installation process to match the thickness of the wall, the need for a rough-in installation is eliminated. This saves time and cost during installation.

Further, the disclosed valve assembly allows for a pivot center for a valve to be placed a predetermined distance from the front side of the wall covering even though the valve assembly is mounted on a rear side of the wall. This allows for adjustment of certain types of valves (e.g., pivoting lever mixing valves) in which there is a spatial or functional relationship between the valve and the escutcheon.

These and still other advantages of the invention will be apparent from the detailed description and drawings. What follows is merely a description of one preferred embodiment of the present invention. To assess the full scope of the invention the claims should be looked to as this preferred embodiment is not intended to be the only embodiment within the scope of the claims.

DETAILED DESCRIPTION OF A PREFERRED EMBODIMENT

Figure 1:
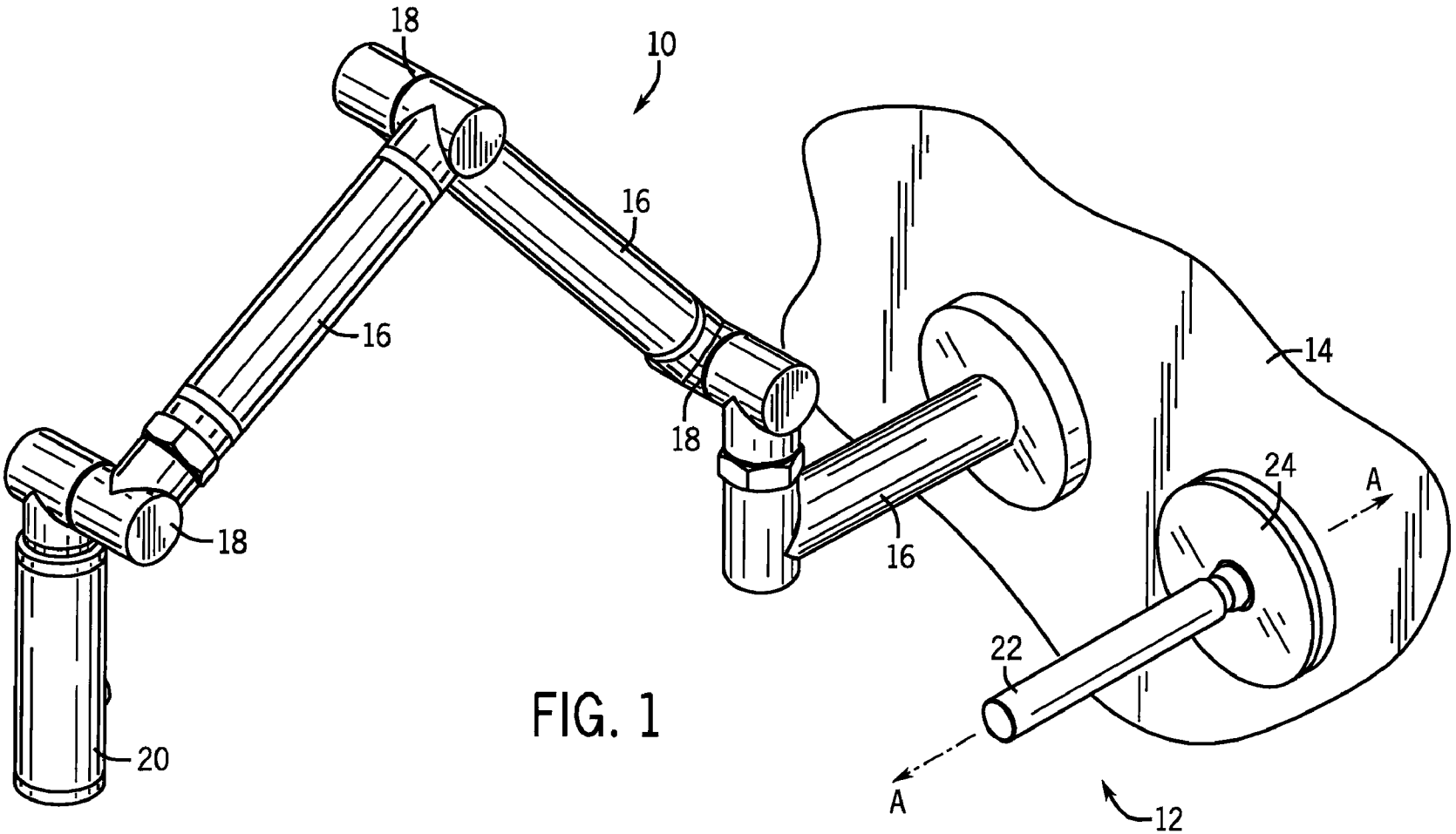
FIG. 1 is an environmental view of a valve assembly and an articulating faucet installed through a vertical wall.

Referring first to FIG. 1, an articulating faucet 10 and a lever handle 12 are installed through a vertical wall 14.

The articulating faucet 10 includes a number of segments 16 linked at joints 18 and extending from inside the vertical wall 14 to a distal spout 20. A waterway (not shown) within the articulating faucet 10 extends through the segments 16 and the joints 18 to the spout 20. The joints 18 provide for the movement of the segments 16 relative to one another, such that the spout 20 may be moved relative to the wall 14 for a desired placement.

To the side of the articulating faucet 10 is the lever handle 12. The lever handle 12 includes a lever 22 that extends from the vertical wall 14. An escutcheon 24 surrounds the lever 22 near the surface of the vertical wall 14. In the closed or off position shown, the lever 22 extends an axis A-A, along which it has a pivot center. This pivot center may be at the intersection of axis A-A and the surface plane of the vertical wall 14 or could along axis A-A at some predetermined distance from the surface plane of the vertical wall 14.

In general operation, the flow of water through the articulating faucet 10 is controlled by the lever 22. In one form of the invention, the lever 22 has an "off" position in which the lever 22 is essentially horizontal and extends perpendicularly from the vertical wall 14. When the lever 22 is lifted about the pivot center, the flow of water through the articulating faucet 10 begins. As the lever 22 is lifted, it can be moved up and leftward to select the flow of hot water from the spout 20 or up and rightward to select the flow of cold water from the spout 20. The lever 22 may also be placed at intermediate locations to select other water temperatures between the hot and cold extremes. Further, the flow rate is determined by the distance the lever 22 deviates from the "off" position. Preferably, when the user moves the lever 22 to the desired position to select temperature and flow rate of the water, the lever 22 has a resistance means that retains the lever 22 in the desired position until the user again moves it, so that the lever 22 does not drop and shut off the flow of water.

Figure 2:
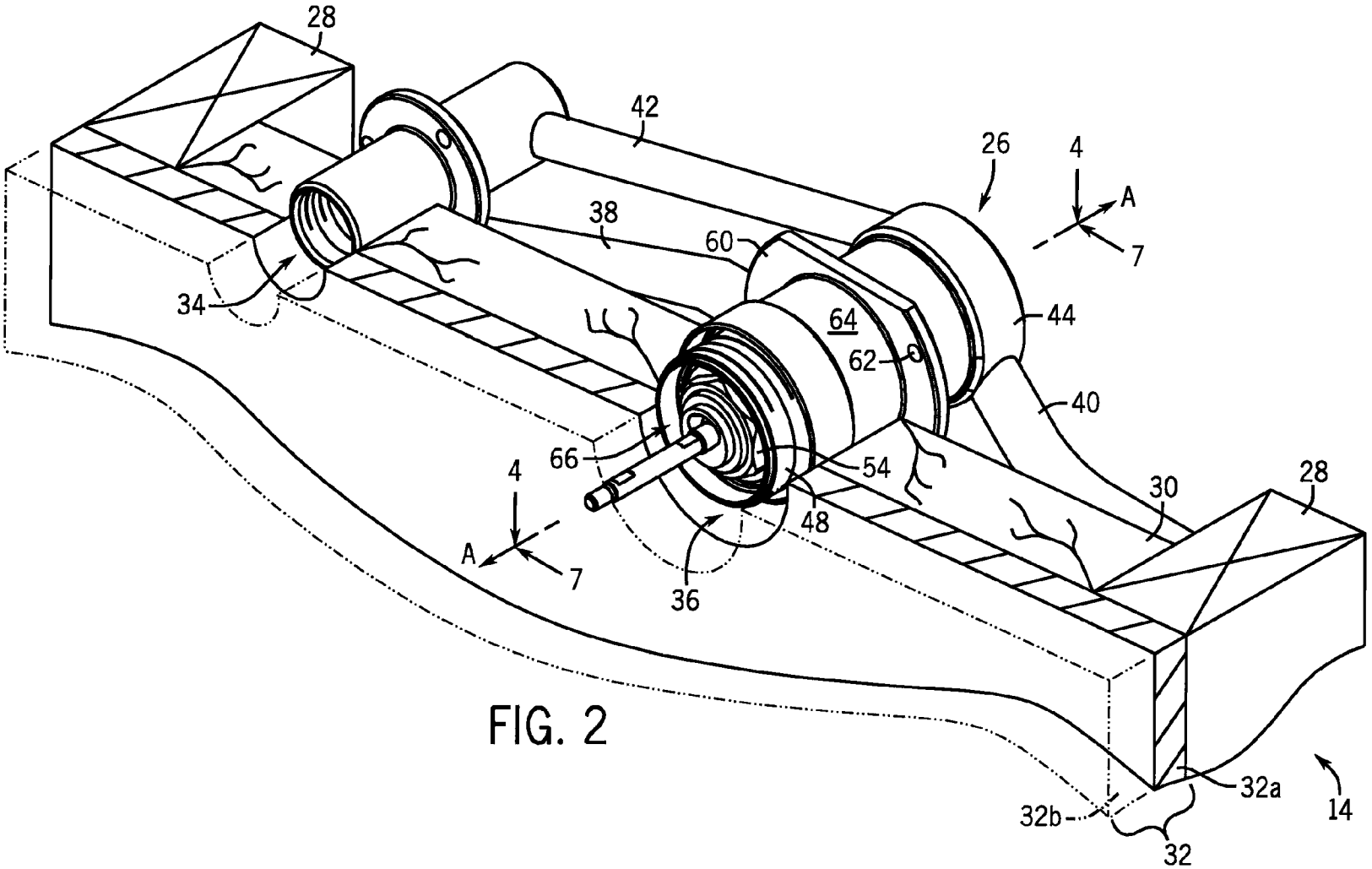
FIG. 2 is a partial cross-sectional view of the vertical wall at one step of the installation process.

Referring now to FIG. 2, a partial cross-section of the vertical wall 14 is shown part way into the installation of a valve assembly 26 which is connected to the lever handle 12. The vertical wall 14 has a wall frame including two vertical studs 28 separated by a distance with a horizontal stud 30 extending therebetween. A wall covering 32 is placed over a front side of the wall frame. A mounting hole 34 for the articulating faucet 10 and a mounting hole 36 for the lever handle 12 and its associated valve assembly 26 extend through the horizontal stud 30 and the wall covering 32.

As shown in FIG. 2, the wall covering 32 may have various layers that contribute to its overall thickness. For example, in the form shown, the wall covering 32 includes a wall board 32*a* and a tile coating 32*b* (shown in phantom lines). However, the wall covering 32 could potentially include wall boards, tiling, paint, and the like, or a combination of such items. Thus, the thickness of the wall covering 32 will vary depending on the item or combination of items that comprise the wall covering 32.

Various water conduits run into and out of the valve assembly 26. In the form shown, a cold water conduit 38 and a hot water conduit 40 bring water into the valve assembly 26. A mixed water conduit 42 provides a pathway for the mixed water from the valve assembly 26 to the articulating faucet 10.

Referring now to FIGS. 3-7, the various components of the valve assembly 26 for the lever handle 12 can be seen. The valve assembly 26 includes a valve body housing 44, two pins 46, a valve body 48, a threaded ring 50, a joystick valve 52, and a bonnet nut 54.

The valve body housing 44 is generally cylindrical in shape, extending from a front end 56 to a rear end 58 along the axis A-A, and holds most of the other components of the valve assembly 26. A radially outwardly extending mounting flange 60 having mounting holes 62 is formed on an outer surface 64 of the valve body housing 44. Extending in from the front end 56 of the valve body housing 44 is an axially-extending inner bore 66. The inner bore 66 generally decreases in diameter as it extends away from the front end 56 of the valve body housing 44 and includes a set of radially inward facing threads 68.

The hot and cold water input pathways 70 and water output pathway 72 are located proximate the rear end 58 of the valve body housing 44. Each of the pathways 70 and 72 extend through the valve body housing 44 from the exterior of the valve body housing 44 to the inner bore 66. The ends of the hot and cold water input pathways 70 at the inner bore 66 each have a port 74 that receives an end of one of the two pins 46.

The two pins 46 are secured in the ports 74 and each have a channel 76 that is in fluid communication with one of the water inlet pathways 70. An o-ring 78 forms a seal between the each of the two pins 46 and the corresponding port 74 into which the pin 46 is inserted. The other end of each of the two pins 46 extend into the inner bore 66 and, as will be described in further detail below, is slidingly received in the valve body 48.

Into the inner bore 66 of the valve body housing 44, the valve body 48 is telescopically received. The axial position of the valve body 48 within the inner bore 66 can be adjusted by moving the valve body 48 along the axis A-A. The threaded ring 50 can be inserted between the valve body housing 44 and the valve body 48 to lock the position of the valve body 48 relative to the valve body housing 44. In particular, the threaded ring 50 has a set of radially outward facing threads 80 that engage the set of radially inward facing threads 68 on the inner bore 66 and a set of radially inward facing threads 82 that engage a set of radially outward facing threads 84 on the valve body 48.

Although the threaded ring 50 has been shown as locking the valve body 48 and the valve body housing 44 together, other locking elements could also be employed to fix the valve body 48 and the valve body housing 44 relative to one another.

Figures 3, 3A:
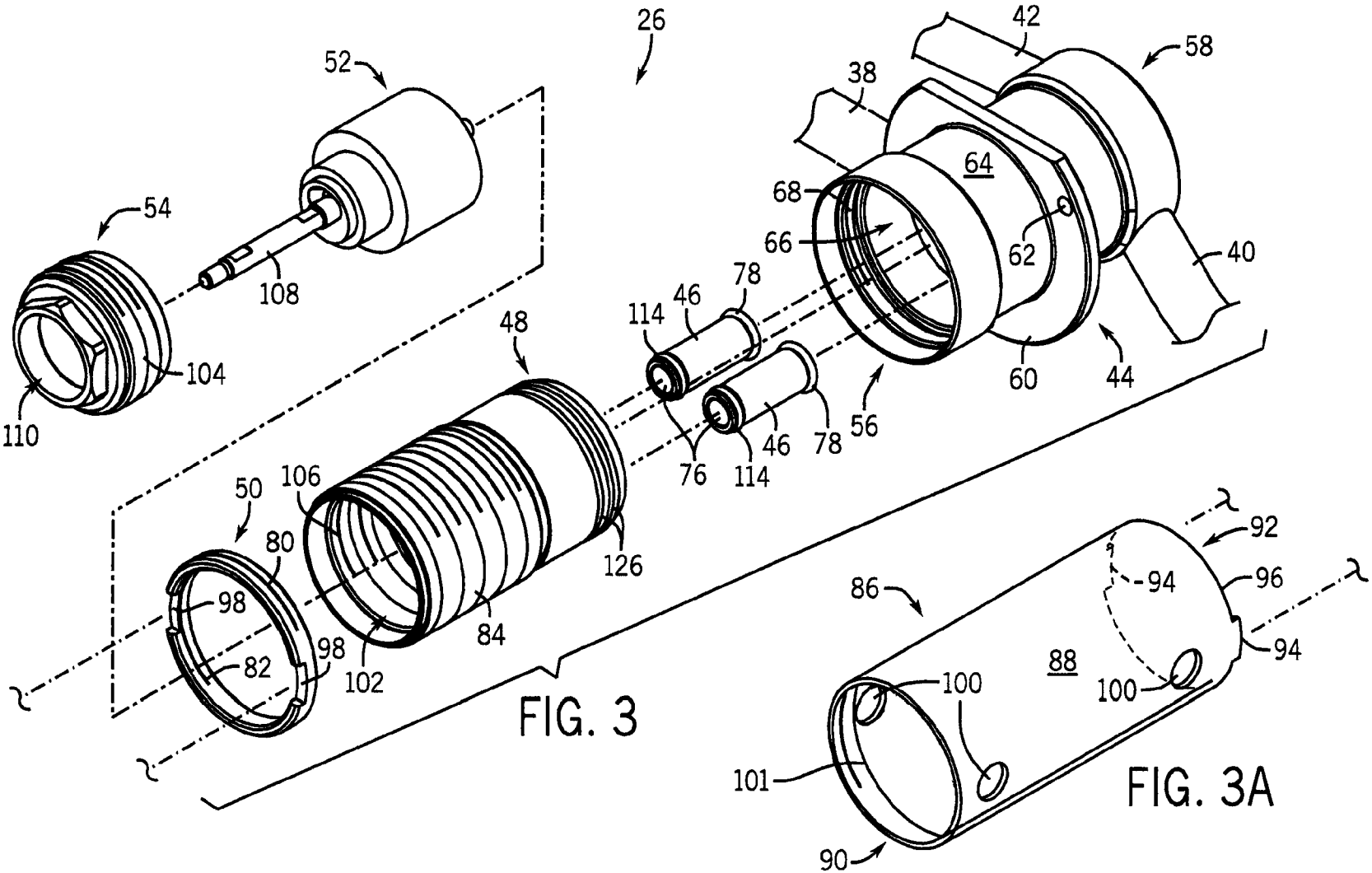
FIG. 3 is an exploded perspective view of the valve assembly.
FIG. 3A is a perspective view of the mud guard.

A multi-purpose tool 86, as is seen in FIG. 3A, can be used to rotatably thread the threaded ring 50 between the valve body 48 and the valve body housing 44 up to a stop 87 formed on the inner bore 66 of the valve body housing 44. The multi-purpose tool 86 has a tubular body 88 extending from first end 90 to a second end 92 and has a set of teeth 94 or other features on a mating edge 96 on the second end 92 that engages matching features (such as cutouts 98) formed on the threaded ring 50. Once the set of teeth 94 on the multi-purpose tool 86 engage the matching feature on the threaded ring 50, the multi-purpose tool 86 may be rotated to drive the threaded ring 50 into place between the valve body 48 and the valve body housing 44, locking the axial position of the items relative to one another. A set of holes 100 extend radially through the tubular body 88 so that a pipe or rod may be inserted therethrough to serve as a torque arm on the multi-purpose tool 86 during the threading process.

In addition to driving the threaded ring 50 between the valve body 48 and the valve body housing 44, the multi-purpose tool 86 can be inserted between the valve body 48 and the valve body housing 44 to act as a mud guard during installation of the wall covering 32. The multi-purpose tool 86 has inward facing threads 101 that can be threaded onto the outward facing threads 84 on the valve body 48 to hold the multi-purpose tool 86 in place when it is being used as a mudguard.

A recess 102 is formed on the valve body housing 44 that receives the joystick valve 52. The joystick valve 52 is secured in the recess 102 by the bonnet nut 54 which has radially outward facing threads 104 that engage radially inward facing threads 106 in the recess 102. A pivotable valve stem 108 extends though a hole 110 in the bonnet nut 54. The pivotable valve stem 108 is covered by the lever 22 or other handle or covering to present a finished appearance. If the valve was an axially rotatable valve, a handle suitable for rotation may be applied.

On the end of the valve body 48 that faces the rear end 58 of the valve body housing 44, two bays 112 are formed in the valve body 48 that slidingly receive the two pins 46 in a direction parallel to the axis A-A. Two o-rings 114 form a slidable seal between a radially outward facing surface of each the two pins 46 and a surface of one of the two bays 112. In this way, the valve body 48 can be moved relative to the two pins 46 while maintaining a seal between the pins 46 and the two bays 112.

Although not shown, the two pins 46 could be fixed relative to the valve body 48 and form a sliding seal with the valve body housing 44.

A pair of inlet channels 116 in the valve body 48 place the two bays 112 in fluid communication with the joystick valve 52 located in the recess 102. Thus, the water from the hot and cold water input pathways 70 flow through the channels 76 in the two pins 46, through the pair of inlet channels 116 in the valve body 48 and into the joystick valve 52.

Figure 7:
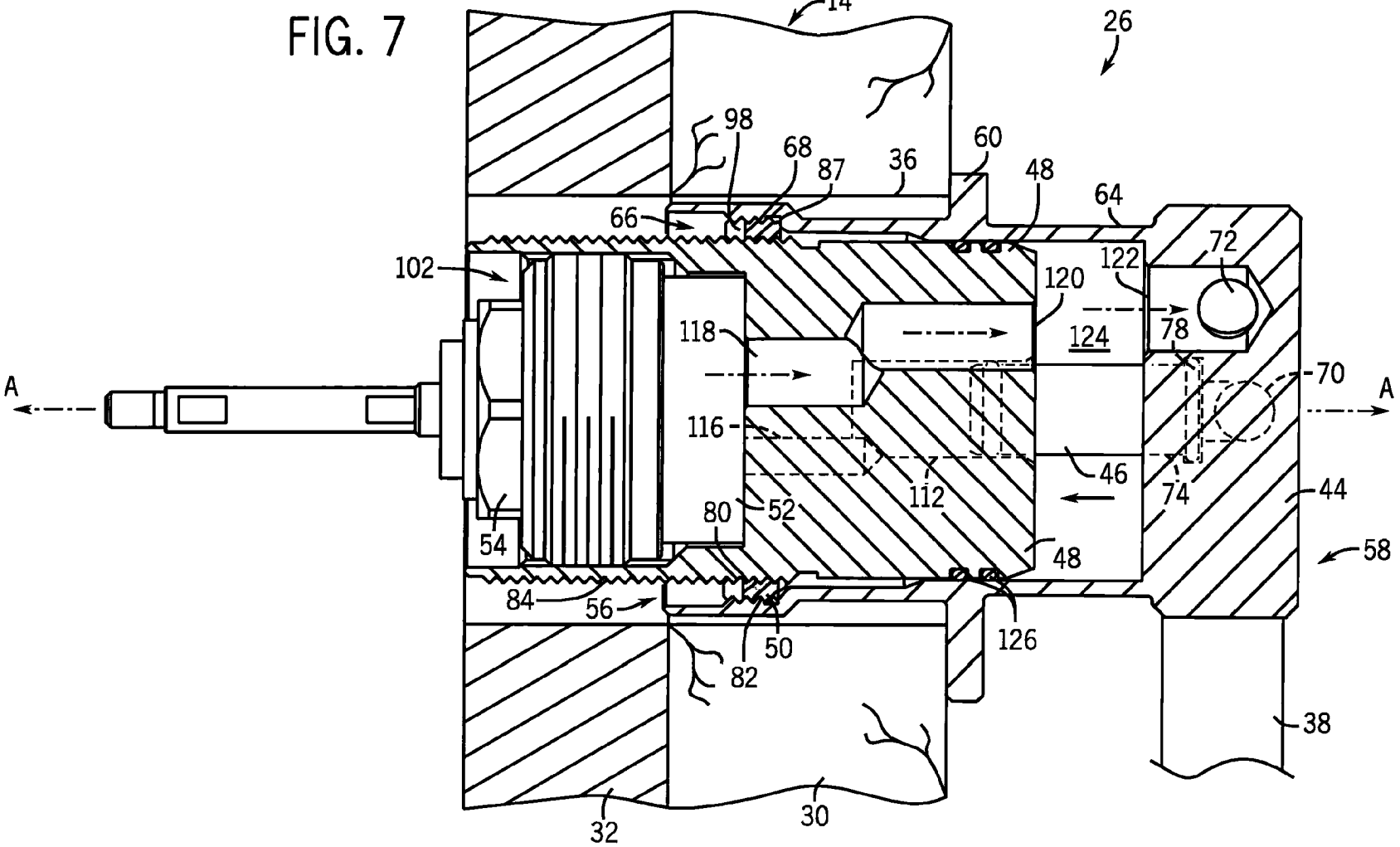
FIG. 7 is a side cross-sectional view of the valve assembly taken along line 7-7 of FIG. 2, but in which the valve assembly has been adjusted in the wall as shown in FIG. 6.

As best seen in FIG. 7, an outlet channel 118 also extends through the valve body 48 from the joystick valve 52 to an opening 120 on the opposite side of the valve body 48. The opening 120 of the outlet channel 118 is preferably positioned to generally align with an opening 122 of the water outlet pathway 72 in the inner bore 66 of the valve body 48 such that if the valve body 48 is fully inserted into the inner bore 66, the outlet channel 118 in the valve body 48 and the water outlet pathway 72 in the valve body housing 44 will remain in fluid communication with one another. However, even if the opening 120 and the opening 122 are not aligned, it is contemplated that the opening 120 of the outlet channel 118 and the opening 122 of the water outlet pathway 72 will be in fluid communication with one another.

Figure 6:
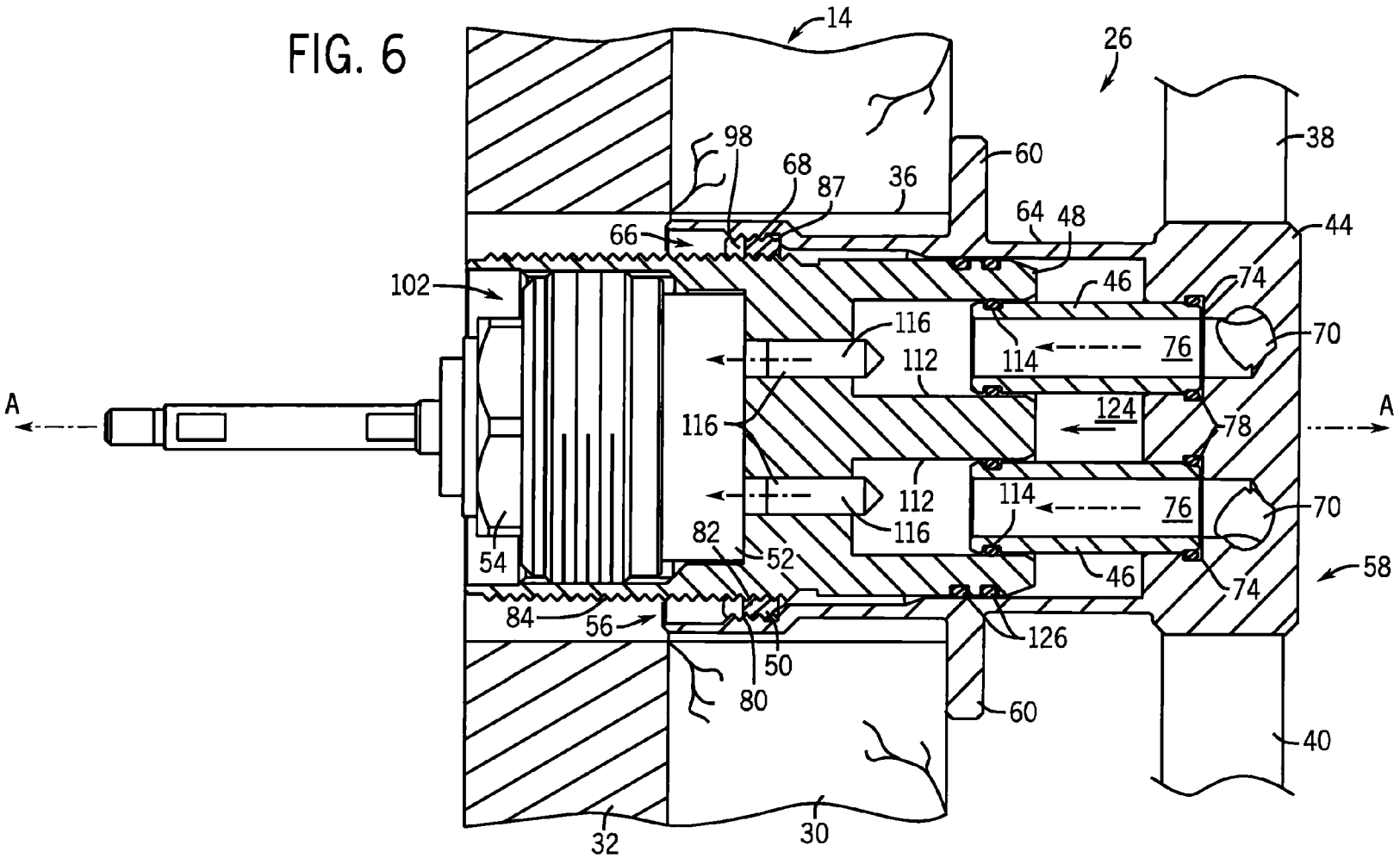
FIG. 6 is a top cross-sectional view of the valve assembly in FIG. 5, but in which the valve body has been adjusted.

As shown in FIGS. 6 and 7, the valve body 48 may be positioned in the valve body housing 44 in such a way that a chamber 124 is formed between the valve body 48 and the valve body housing 44 proximate the rear end of the inner bore 66. When the chamber 124 is formed, the chamber 124 places the outlet channel 118 in the valve body 48 in fluid communication with the water outlet pathway 72 of the valve body housing 44. A pair of coaxial o-rings 126 form a sliding seal between the valve body 48 and walls of the inner bore 66 of the valve body housing 44 to contain any outward flowing mixed water in the chamber 124. This sliding seal, in combination with the sliding seal between the two pins 46 and the valve body 48, allows for the valve body 48 to be moved with respect to the valve housing body 44 while maintaining proper fluid communication between valve components despite the movement of the many of the components with respect to one another.

It should be appreciated that although the chamber 124 has been shown as placing the outlet channel 118 of the valve body 48 in communication with the water outlet pathway 72 in the valve body housing 44, that a pin with a channel running therethrough could also place the two in fluid communication with one another in a manner similar to the two pins 46 place the hot and cold inlet water pathways 70 in communication with the pair of inlet channels 116.

To install the valve assembly 26 in the wall 14 the following actions can be taken. The hole 36 sized to receive the valve assembly 26 is drilled through the horizontal stud 30. The valve body housing 44 is inserted into the hole 36 until the outwardly extending mounting flange 60 is flush with the rear side of the horizontal stud 30. The mounting flange 60 is secured to the rear side of the horizontal stud 30 by using appropriate mounting hardware (e.g., screws or the like). The wall covering 32 is applied in as many steps as necessary. Applying the wall covering 32 may include installing the wall board 32*a* and subsequent application of the tile coating 32*b*, paint, or the like. Holes are provided through the wall covering 32 to allow access to the valve assembly 26.

During the installation of the wall covering 32, the multi-purpose tool 86 may be inserted between the valve body 48 and the valve body housing 44 to act as a mud guard. In the form shown, this insertion occurs by threading the inward facing threads 101 on the multi-purpose tool 86 onto the outward facing threads 84 on the valve body 48. This protects the valve assembly 26 from debris and the like.

Once the wall covering 32 is installed, the valve body 48 is adjusted relative to the valve body housing 44. The valve body 48 is moved within the valve body housing 44 to position the valve body 48 relative to the front side of the wall covering 32. This may include positioning a pivot center of the joystick valve 52 relative to the front side of the wall covering 32. In some forms, this may involve position the valve body 48 such that a particular edge of the valve body 48 is essentially flush with the front side of the wall 14.

After the valve body 48 has been positioned relative to the front side of the wall 14, the valve body 48 is locked relative to the valve body housing 44 using the threaded ring 50 or another locking element. In the form shown, the threaded ring 50 is inserted between the valve body 48 and the valve body housing 44 and threaded into both using the multi-purpose tool 86 as described above.

Figure 4:
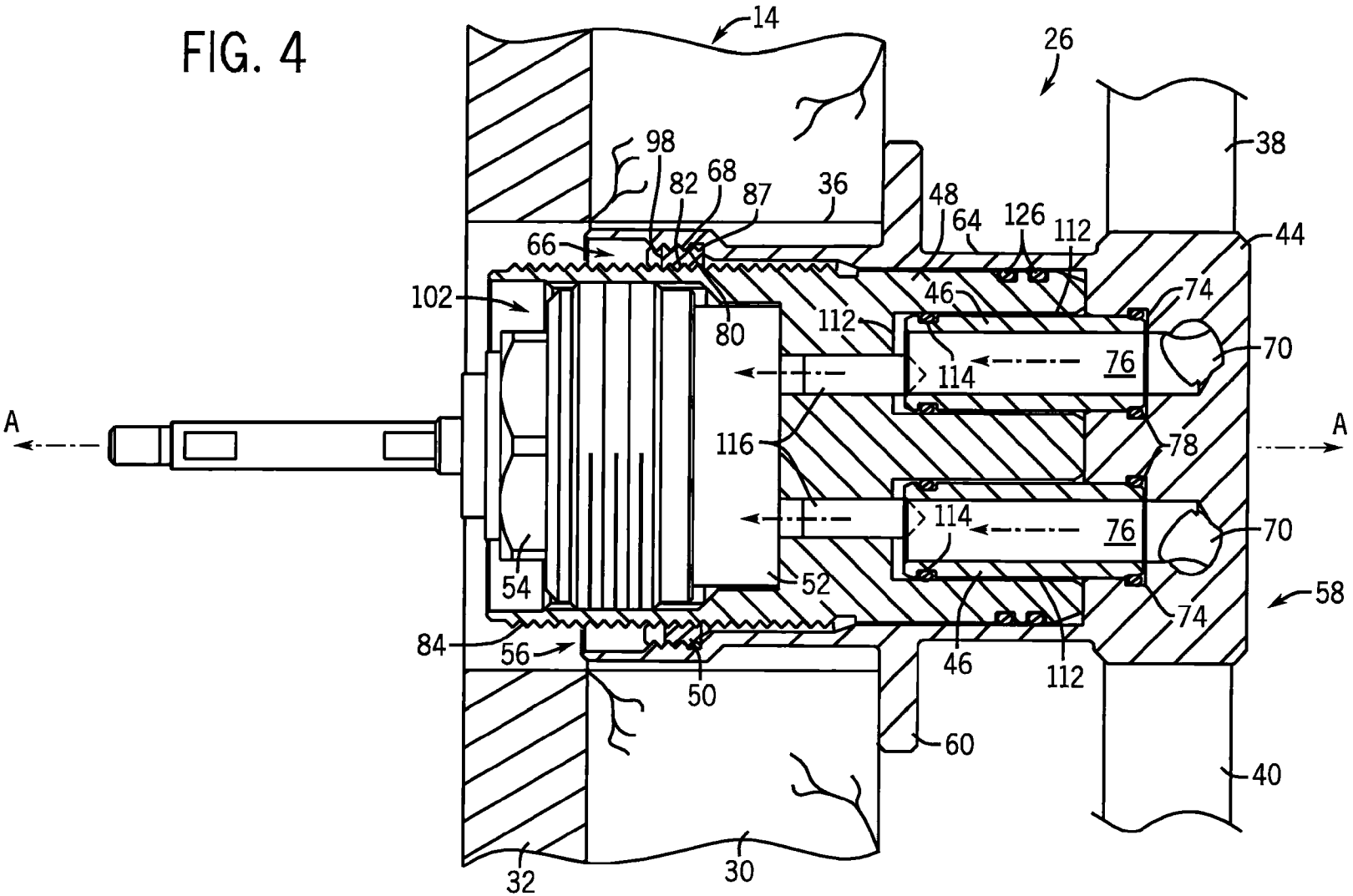
FIG. 4 is a top cross-sectional view of the valve assembly in the wall taken along line 4-4 of FIG. 2.
Figure 5:
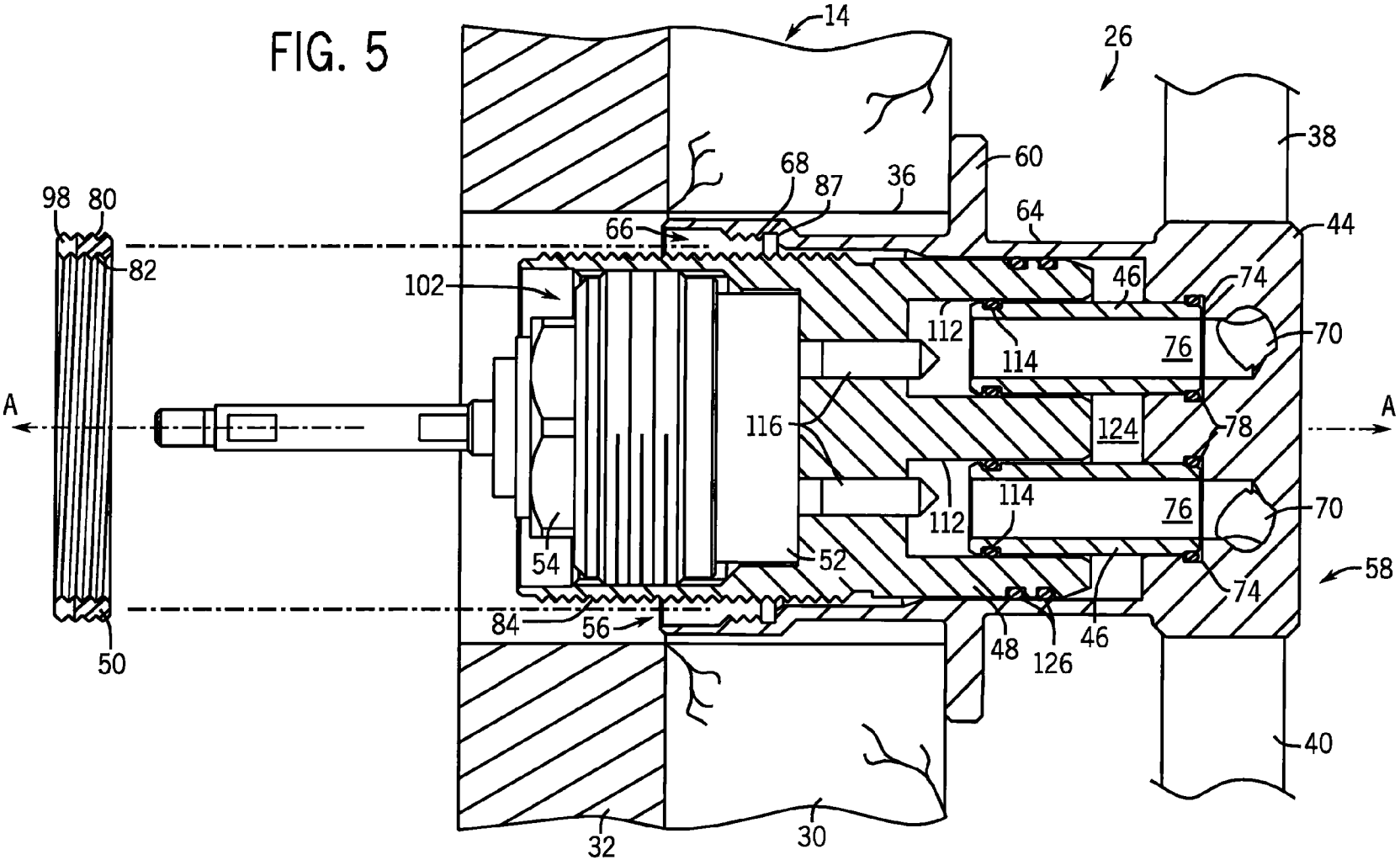
FIG. 5 is a top cross-sectional view of the valve assembly similar to FIG. 4, but in which the thickness of the wall covering has been increased.

This adjustment process can be seen in FIGS. 4-6, in which the wall covering 32 is built up, the threaded ring 50 is temporarily removed so that the valve body 48 can be moved within the inner bore 66 of the valve body housing 44 to reposition the valve body 48 relative to the front surface of the wall covering 32, and the threaded ring 50 is again inserted between the valve body 48 and the valve body housing 44 to lock the two relative to one another.

Finally, any additional exterior coverings may be applied. For example, the escutcheon 24 and lever 22 or other handle may be attached to the valve assembly 26 or the wall 14 to provide the desired appearance.

Thus, a valve assembly is disclosed that can be mounted to a rear side of a wall, but can be adjusted to accommodate for various wall thicknesses. Unlike other adjustable valve assemblies that depend upon variable escutcheon placement, the disclosed valve assembly has telescoping parts that allow adjustment of some of the functional valve components. For example, the pivot center of a joystick valve can be adjusted relative to a front face of the wall. Thus, the disclosed valve assembly offers an improved form of adjustment for suitable for various types of valves, and not only for valves having a stem rotatable about a rotational axis. The disclosed valve assembly further allows for the elimination of a rough-in installation, saving time and expense during installation.

Additionally, a multi-purpose tool is disclosed that can act as a tool for locking components of the valve assembly together and also acts as a mud guard during installation of the wall covering.

It should be appreciated that various other modifications and variations to the preferred embodiment can be made within the spirit and scope of the invention. Therefore, the invention should not be limited to the described embodiment. To ascertain the full scope of the invention, the following claims should be referenced.

INDUSTRIAL APPLICABILITY

The invention provides an adjustable valve assembly having a valve body that is telescopically received in a valve body housing, in which the valve body housing may be mounted to the rear side of the wall and the valve body may be positionally adjusted to accommodate for various thickness wall coverings.

What is claimed is:

1. A valve assembly for mounting through a wall having a first face and a second face defining a thickness there between, the valve assembly comprising:

a valve body housing having an axially-extending inner bore;

a valve body telescopically received in the inner bore of the valve body housing, the valve body being axially movable with respect to the valve body housing;

a valve nested in a recess of the valve body; and a locking element for selective engagement between the valve body housing and the valve body to lock a position of the valve body relative to the valve body housing;

wherein a radially outward facing surface of the valve body and a radially inward facing surface of the inner bore of the valve body housing each have threads, wherein the locking element is a threaded ring having radially outward facing threads that selectively engage the threads of the valve body housing and radially inward facing threads that selectively engage the threads of the, valve body.

2. The valve assembly of claim 1, wherein the inner bore of the valve body housing includes a stop adjacent to the threads on the inner bore of the valve housing.

3. The valve assembly of claim 1, wherein the valve is a joystick valve having a pivot center.

4. The valve assembly of claim 3, wherein when the valve body housing is mounted to a first side of the wall, the valve body is adjustable such that a pivot center of the joystick valve received therein is a predetermined distance from a second side of the wall.

5. The valve assembly of claim 1, further comprising a mounting flange on the valve body housing.

6. The valve assembly of claim 1, further comprising a pin having a channel running therethrough, the pin being fixed relative to the valve body housing and slidably received in a bay formed in the valve body.

7. The valve assembly of claim 6, wherein the channel in the pin places the valve in fluid communication with a port on the valve body housing that connects to a water inlet pathway formed in the valve body housing.

8. The valve assembly of claim 7, wherein the valve body includes at least one inlet channel formed therein to place the bay in fluid communication with the valve nested in the recess.

9. The valve assembly of claim 8, wherein the valve body further includes an outlet channel to place the valve in fluid communication with a water outlet pathway formed in the valve body housing.

10. The valve assembly of claim 6, further comprising a first o-ring between the pin and the bay that forms a first slidable seal and a second o-ring between the valve body and the valve body housing that forms a second slideable seal.

11. A multi-purpose tool for installation of the valve assembly as in claim 1, the multi-purpose tool comprising:

a tubular body extending along an axis from a first end to a second end; and a mating edge on the first end having teeth for engagement with corresponding features on the locking element;

wherein the multi-purpose tool inserts between the valve body and the valve body housing to selectively engage the locking element;

wherein the multi-purpose tool serves as a mud guard during an installation of a wall covering.

12. The multi-purpose tool of claim 11, wherein the tubular body has at least one radially-extending hole formed therein.

13. A method of installing a valve assembly including a valve body and a valve body housing into a wall having a first side and a second side defining a thickness there between, the method comprising:

telescopically moving the valve body into an axially-extending inner bore of the valve body housing;

mounting the valve body housing to a wall member on the first side of the wall;

applying a wall covering to the wall member to provide a second side of the wall;

moving the valve body within the valve body housing to position the valve body relative the second side of the wall; and locking the valve body relative to the valve body housing using a locking element in the form of a threaded ring;

wherein a radially outward facing surface of the valve body and a radially inward facing surface of an inner bore of the valve body housing each have threads, wherein the locking is facilitated by the threaded ring having radially outward facing threads that selectively engage threads of the valve body housing and radially inward facing threads that selectively engage threads of the valve body.

14. The method of claim 13, further comprising installing a handle to the valve assembly on the second side of the wall.

15. The method of claim 13, wherein the step of moving the valve body within the valve body housing to position the valve body relative to the second side of the wall includes positioning a pivot center of the valve relative to the second side of the wall.

* * * * *